US006819205B2

(12) United States Patent
Bach et al.

(10) Patent No.: US 6,819,205 B2
(45) Date of Patent: Nov. 16, 2004

(54) CURRENT LIMITING LOW-VOLTAGE POWER CIRCUIT BREAKER

(75) Inventors: Michael Bach, Berlin (DE); Detlev Schmidt, Berlin (DE); Michael Sebekow, Berlin (DE); Günter Seidler, Berlin (DE); Ingo Thiede, Berlin (DE); Sezai Türkmen, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/415,151

(22) PCT Filed: Jul. 23, 2001

(86) PCT No.: PCT/DE01/02820

§ 371 (c)(1),
(2), (4) Date: Sep. 11, 2003

(87) PCT Pub. No.: WO02/35570

PCT Pub. Date: May 2, 2002

(65) Prior Publication Data

US 2004/0056744 A1 Mar. 25, 2004

(30) Foreign Application Priority Data

Oct. 27, 2000 (DE) ..... 100 54 383

(51) Int. Cl.[7] ..... H01H 83/00
(52) U.S. Cl. ..... 335/16; 335/132; 218/22
(58) Field of Search ..... 335/16, 147, 165–176, 335/132, 202, 185–195; 218/22; 200/400–401

(56) References Cited

U.S. PATENT DOCUMENTS 4,998,081 A 3/1991 Boyd
5,566,818 A 10/1996 Kuboyama et al.
6,218,921 B1 * 4/2001 Eberts et al. ..... 335/176
6,376,788 B1 * 4/2002 Jones et al. ..... 200/244

FOREIGN PATENT DOCUMENTS

| | | |
|---|---|---|
| DE | 250749 | 12/1963 |
| DE | 1463311 | 2/1969 |
| DE | 1463312 | 3/1969 |
| DE | 1513341 | 12/1969 |
| DE | 1801071 | 12/1969 |
| DE | 2511948 | 9/1976 |
| DE | 19630470 | 8/1997 |
| DE | 19740422 | 3/1999 |
| EP | 0398461 | 3/1991 |
| FR | 721451 | 3/1932 |

* cited by examiner

*Primary Examiner*—Lincoln Donovan
(74) *Attorney, Agent, or Firm*—Harness Dickey

(57) ABSTRACT

A low-voltage power circuit breaker includes a current-limiting opening of a mobile switching contact. The force-transmitting connection between the actuating shaft lever and the mobile switching contact or the contact support is provided in the form of a latching device and includes two identical levers, which can pivot in relation to one another around an articulated joint and which are joined to one another by way of the articulated joint that is formed by a joint pin guided through aligned continuous borings provided in concentric parts of the levers. The contact surfaces of the levers have slanted surfaces that serve as a tooth. In the vicinity of the articulated joint, the levers are subjected to the action of an adjustable spring force, which is exerted by a pressure spring and which acts upon the tooth.

20 Claims, 2 Drawing Sheets

CURRENT LIMITING LOW-VOLTAGE POWER CIRCUIT BREAKER

This application is the national phase under 35 U.S.C. §371 of PCT International Application No. PCT/DE01/02820 which has an International filing date of Jul. 23, 2001, which designated the United States of America and which claims priority on German Patent Application number DE 100 54 383.9 filed Oct. 27, 2000, the entire contents of which are hereby incorporated herein by reference.

FIELD OF THE INVENTION

The invention generally relates to a current-limiting low-voltage circuit breaker. More preferably, it relates to one having a contact system which can be latched by use of a switching mechanism and having at least one moving contact element and at least one fixed contact element per phase. The moving contact element is preferably raised as a consequence of electrodynamic forces against the influence of a contact force spring when heavy currents occur, for example in the event of short circuits. Further, it preferably has the following features:

- a drive apparatus for moving the switching contact to a connected position and to a disconnected position,
- a latching device which is arranged in the path of the force transmission from the drive apparatus to the switching contact, which latching device, starting with the switching contact in the connected position, can be released by means of an opening force which originates from the switching contact and acts in the direction of the disconnected position, when the opening force exceeds a predetermined limit value, with the latching device being in the form of a mechanical connecting element between the drive apparatus and the moving switching contact, and having at least two interacting working surfaces, which are arranged at an angle to the direction of the opening force, and a contact-pressure spring which acts on the working surfaces.

BACKGROUND OF THE INVENTION

It is desirable for current-limiting low-voltage circuit breakers to have extremely short tripping times, of a few milliseconds. The normal tripping times for circuit breakers are longer because, in the case of a classical design of a dynamically fixed circuit breaker, that is to say a circuit which operates with tripping that can be staggered selectively, the contact system is intrinsically completely rigid. The contacts remain closed until they are released at another point. The tripping magnet must be caused to respond, which takes a comparatively long time, and a complete switching mechanism must be released for this purpose, in which a relatively large number of parts have to be moved. However, this also means that the switch has to withstand the high load from the current carrying capability and that it is not damaged or destroyed in advance by overheating. This can be overcome by using the electrodynamic current forces themselves to open the contacts. There are a number of different principles for achieving this.

One of these principles is to make it possible for the lifting-off contact forces to come into effect when heavy currents occur before normal mechanical latching in the switch drive is released. This is based on the idea that each of the contacts, which meet one another in the form of a butt connection, experiences a repulsion effect as a result of the high current density forces, and they are disconnected at a specific current intensity, unless the contents are held together by external forces. When the contacts are opened, the switching mechanism must then also be moved to the disconnected position and the contact support must once again be locked with the switching mechanism. In the process, it is desirable for possibly a single pole of a multi-pole circuit breaker to be caused to open under the influence of these forces while the others still remain closed, since it is just this one pole which is carrying the heavy current. When this extremely fast opening takes place, a switching arc occurs, and its resistance in comparison to the resistances of the current paths via the entire fault location and the switch are so large that this produces a current-limiting effect. The short-circuit current therefore cannot reach its full magnitude.

The described process can be achieved in a different way. If the requirements are not stringent and if the switching mechanism is designed particularly well, in particular with the parts that need to be moved having a small mass, it is sufficient to release it on three poles. However, as already mentioned, it is better to produce single-pole interruption of the relevant current path, since this results in a higher current limiting factor.

FR-PS 721 451 describes a DC voltage quick-action switch, in which the current forces are produced by way of an electromechanical transducer which is isolated from the contact system and responds to an increase in current. AT-PS 250 479 discloses a current-limiting switch whose moving switching lever is held in the connected position by a latching mechanism which can be released not only by means of an electromagnetic overcurrent release but also by way of a movement of the moving switching lever caused by electrodynamic forces. The transmission of the tripping movement of the overcurrent release to the latching point in this case makes use of two or more intermediate elements.

DE-PS 1 801 071 discloses a low-voltage circuit breaker having a current path which is in the form of a loop and produces contact-opening forces which drive the contacts apart from one another, and in which the switching lever is moved against the force of a spring in the contact system by way of the electrodynamic forces which occur in the event of particularly heavy overcurrents. A rod is provided on the moving contact lever and is supported by a roller on a blocking element. This blocking element, which can itself be moved against spring force, and a roller are used to move and release a catch lever, by which the switching lever can be moved to the disconnected position.

DE 14 63 312 A1 describes another possible way to use current forces to open contacts quickly. In this case, the contact which is raised by a heavy current occurring and which is mounted at a floating rotation point is fixed in the open position by way of a latching mechanism, and the normal energy store tripping shaft is operated via a lever mechanism, by which the switch is moved to its final disconnected position.

DE 15 13 341 A1 describes a further such circuit breaker, in which, when a heavy short-circuit current occurs, the electrodynamic forces result in a repulsion effect occurring between the two contact elements. In the process, when the contact support pivots with the moving contact in a locking device, the locking of the contact support to the switching mechanism is released, and a supporting lever is rotated. The tripping shaft is rotated via two further levers, which act as a double lever, and causes the switching mechanism to unlatch.

DE 1 463 311 A1 discloses another solution for current-limiting disconnection. In this type of construction, the moving contact piece is mounted in a hinged manner on a lever which pivots. In the event of a short circuit, the movement of the moving contact piece causes a contact piece barrier to be released as a result of electromagnetic forces, so that the contact spring stress is released and the moving contact piece is moved to the off position.

DE 25 11 948 A1 describes a switch in which an electrodynamic opening movement of the moving contact piece results in a lever arrangement being operated, in order to unlatch the switching mechanism directly, immediately after contact opening and as the contact spring force rises. To achieve this, the moving contact piece is mounted on a support such that it can rotate and, when it is in the connected position, is pressed against the fixed contact piece by a contact force spring which is supported on the support. The support is mounted at a rotation point whose position is fixed, and is rigidly locked by the switching mechanism in the connected state. The opening movement of the moving contact piece in order to unlock the support is passed via a lever arrangement to the switching mechanism, and to the lock for the support.

EP 0 398 461 A2 discloses a circuit breaker having a drive apparatus and a latching device for a moving switching contact, in which a mechanically nonlinear element is inserted in the drive apparatus. In terms of its method of operation, this is essentially formed from parts which can be pushed into one another telescopically. Both have inclined surfaces which interact with one another and on which a spring or springs acts or act. When the forces acting on the connection exceed the normal contact pressure force by a specific amount, the inclined surfaces suddenly slide off on one another, and the contact support to which the force is applied is suddenly moved to the disconnected position, in order to produce a current-limiting switching arc.

DE 197 40 422 A1 discloses the provision of an articulated lever connection for the connection between the moving contact lever support and the switching shaft, which articulated lever connection is formed by lug elements which are connected to one another in a hinged manner and on which a spring acts such that they assume an extended position. The moving contact lever support is in this case not rigid, as has been normal until now, but is connected to its supporting levers by means of a pivoting bearing, which is preferably formed by a shaft, so that it can carry out a pivoting movement. It has a pocket which is used for holding and for connecting the lug element (which is hinged on the moving contact lever support) of the articulated lever connection to the moving contact lever support by way of a coupling bolt, and has an inclined surface which is formed by one edge of the pocket, in order to influence the contact lever support by way of its pivoting movement onto one of the lug elements. In consequence, the lug elements are deflected from their extended position, and the initially rigid articulated lever connection is bent. In the area of the contact lever shaft which passes through it in normal switches, the moving contact lever support is provided with cutouts which are designed such that its pivoting movement is not impeded by this contact lever shaft.

SUMMARY OF THE INVENTION

All the abovementioned switches share the disadvantage that a large number of moving parts, in some cases including components which are additionally required only for current limiting, are provided in order to produce the current limiting effect. This is associated with a high degree of mechanical and manufacturing complexity.

Furthermore, it must be remembered that customers require not only a switch of a type such as this but also one which opens conventionally, that is to say selectively, that is to say only when a specific time has passed when a heavy current occurs. However, it is highly complex to offer the customer two types of circuit breakers which are constructed in entirely different ways, since two different switch designs must be kept available. In consequence, only half the batch size can thus be manufactured for each of the two types. Nowadays, the customers frequently convert their systems, and therefore require low-cost circuit breakers, which can be used universally.

The aim of alternatively providing the different functions of classical circuit breakers, which can be staggered selectively as a function of time, or current-limiting switches should therefore be achieved at as low a cost as possible.

In consequence, an object of an embodiment of the invention is to propose a current-limiting low-voltage circuit breaker which can be derived from a normal switch that is in large-scale production without any major design or manufacturing complexity, without having to make any major modifications to it. Conventional switches have one moving switch pole with a switching contact with a switch drive and, in between, a lever chain which connects the switching shaft and the contact support. Thus, it is possible to install an element in the path of the lever chain, which element has a mechanically nonlinear characteristic, to the extent that the lever chain can flex, bend out or bend in independently of the switching shaft when the current lifting-off forces cause the contact support to press against the lever chain.

Against this background, an object of an embodiment of the invention may be achieved in that the transmission of the force, which is previously in the form of a lever chain, from the switch drive to the contact support is completely physically modified to the extent that it is constructed in the form of an articulated element.

The current-limiting circuit breaker according to an embodiment of the invention with a moving switching contact, with a drive apparatus for moving the switching contact to a connected position and to a disconnected position, a latching device which is arranged in the path of the force transmission from the drive apparatus to the switching contact, which latching device, starting with the switching contact in the connected position, can be released by the use of an opening force which originates from the switching contact and acts in the direction of the disconnected position, when the opening. force exceeds a predetermined limit value, with the latching device being in the form of a mechanical connecting element between the drive apparatus and the moving switching contact, and having at least two interacting working surfaces, which are arranged at an angle to the direction of the opening force, and a contact-pressure spring which acts on the working surfaces, has the following features:

- the latching device has two levers which are connected to one another by a hinged joint which is formed by a hinge bolt, which is passed through aligned through-holes in concentric parts of the levers, which levers are designed to be identical and which can pivot relative to one another about the hinged joint,
- the levers have inclined surfaces which act as a toothed system, on the concentric parts on their touching surfaces in the area of the hinged joint, which are arranged concentrically around the through-holes for the hinge bolt,
- a spring force, which acts on the toothed system that is formed by the inclined surfaces on their touching surfaces acts on the concentric parts of the levers, in the area of the hinged joint, by means of a contact-pressure spring, when the latching device is in the rest state, the levers are at an angle to one another, which is not the same as the angle when they are in the extended position, in order to produce a relative torque which is dependent on the opening force, those ends of the levers which face away from the hinged joint have holders, which are provided with through-holes for hinged connection to the switching contact and, respectively, to the drive apparatus.

The hinge bolt expediently has a head at one of its ends as an opposing bearing for the contact-pressure spring, and has a thread for a nut at its other end. The inclined surfaces, which are used as a toothed system and can be moved toward one another when the latching device is loaded in the rotation direction of the levers, are designed with steep flanks as snap-action surfaces, and the inclined surfaces which are moved away from one another when the latching device is loaded in the rotation direction of the levers have flat flanks as sliding surfaces.

The contact-pressure spring is advantageously in the form of a helical compression spring which surrounds the hinge bolt and is supported on the head of the hinge bolt.

The axis of the hinged joint which connects the levers is expediently arranged parallel to a pivoting axis of the moving switching contact.

The contact-pressure force which is exerted by the contact-pressure spring on the touching surfaces of the levers on the concentric parts in the area of the hinged joint by means of the inclined surfaces which act as a toothed system can be adjusted by varying the effective length of the hinge bolt.

This change in the effective length of the hinge bolt is achieved in a simple manner by screwing the nut on_further or to a lesser extent. The latching device according to an embodiment of the invention creates a new assembly for the force-transmitting connection of the switching shaft lever to the switching contact, and to the contact support. It is designed as an element which bends out as a function of the force and allows each of the switching units to open independently of one another and independently of the switching shaft being in the ON position when a short-circuit current occurs. The two levers of the latching device are designed to be identical.

Thus, from the manufacturing point of view, only one part need be produced. The inclined surface, which are designed as a toothed system for the concentric parts of the levers, are subject to the spring pressure from a contact-pressure spring, which is designed such that a defined force can be transmitted for connection and for producing the contact forces, without bending out. The spring force of the contact-pressure spring can in this case be varied continuously, so that the desired bending-out force for the latching device can likewise be varied continuously. The latching device according to an embodiment of the invention is not pushed together telescopically as in the known embodiments, and a rotary bending movement is carried out instead. When the electromagnet quick-action release finally disconnects the switch as the disconnection process continues further, the rotating switching shaft and its switching shaft lever result in the latching device being returned to its rest position. The switch is thus ready for reconnection.

BRIEF DESCRIPTION OF THE DRAWINGS

The invention will be explained in more detail in the following text, in order to assist understanding, with reference to one preferred exemplary embodiment, although this does not restrict the scope of protection.

DETAILED DESCRIPTION OF THE PREFERRED EMBODIMENTS

Figure 1:
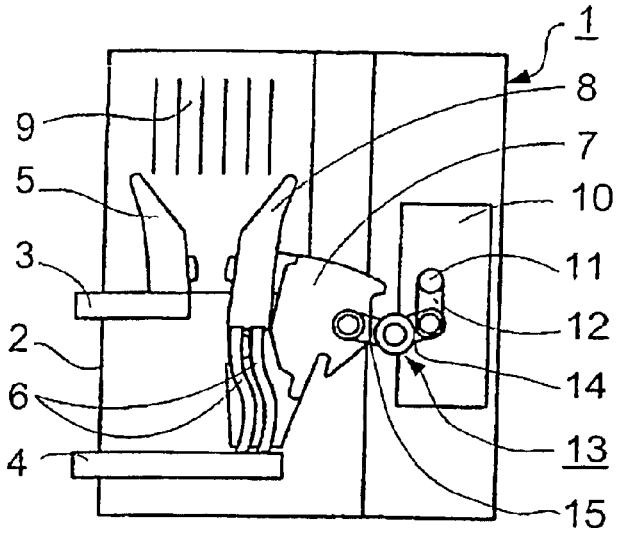
FIG. 1 shows, schematically, a low-voltage circuit breaker with the latching device according to an embodiment of the invention, illustrated in the form of a section in the disconnected state.
Figure 2:
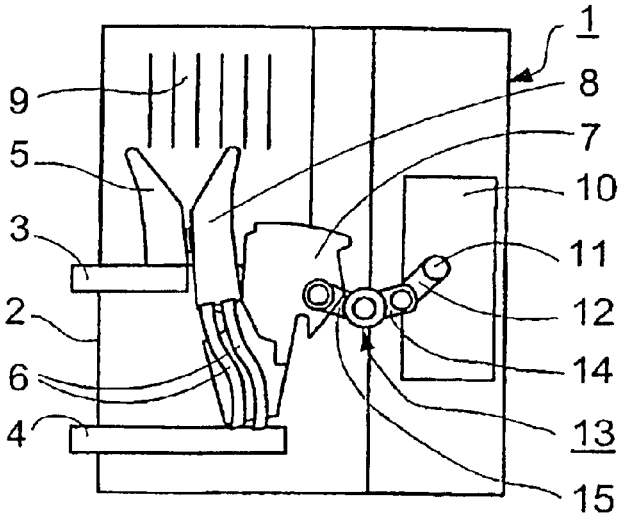
FIG. 2 shows, schematically, a low-voltage circuit breaker with the latching device according to an embodiment of the invention, illustrated in the form of a section in the connected state.
Figure 3:
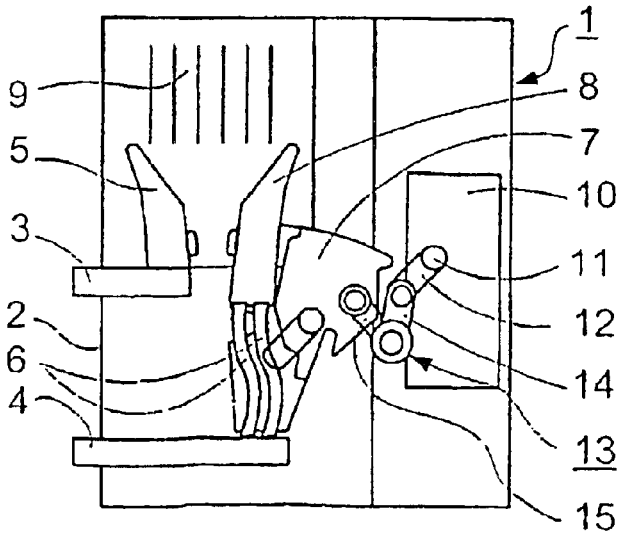
FIG. 3 shows, schematically, a low-voltage circuit breaker with the latching device according to an embodiment of the invention, illustrated in the form of a section in the tripped state.

FIGS. 1 to 3 show a schematic section view of a low-voltage circuit breaker 1, in order to illustrate the installation location of the latching device 13 according to an embodiment of the invention. The upper connecting rail 3 and the lower connecting rail 4 are passed through the rear wall 2 of the low-voltage circuit breaker 1. The stationary switching contact 5 is located on the upper connecting rail 3, and the moving switching contact 8, which is located on a contact support 7, is connected to the lower connecting rail 4 via flexible connections 6. The arcing chamber 9 is arranged above the fixed switching contact 5 and the moving switching contact 8. The switch drive 10 includes the switching shaft 11 with the switching shaft lever 12, to which the latching device 13 according to the invention is attached as a connecting element to the contact support 7.

In FIG. 1, with the low-voltage circuit breaker 1 in the disconnected state, the levers 14; 15 are shown with the latching device 13 in the rest state in order to produce a relative torque which is dependent on the opening force, at an angle to one another which is not the same as the angle when they are in the extended position, with the axis of the hinged joint 16 which connects the levers 14; 15 being arranged parallel to a pivoting axis, which is not shown, of the moving switching contact 8. FIG. 2 shows the same constellation, but with the low-voltage circuit breaker 1 in the connected state, while FIG. 3 shows the low-voltage circuit breaker 1 with the latching device 13 in the tripped state, in which the latching device 13 is bent in, and the moving contact 8 has been opened.

Figure 4:
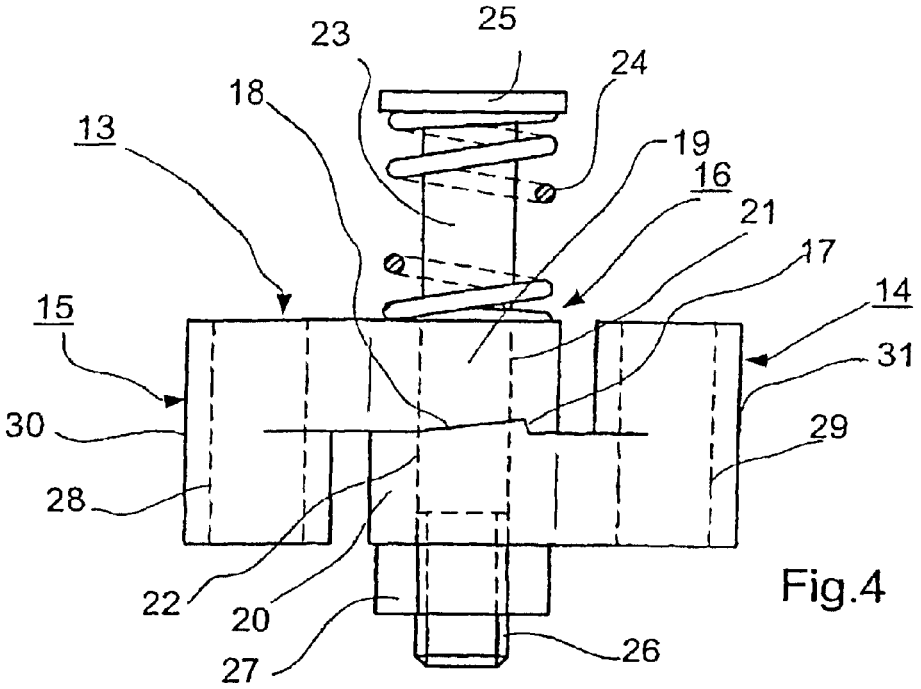
FIG. 4 shows a side view of one preferred embodiment of the latching device according to an embodiment of the invention.

FIG. 4 shows a side view of one preferred embodiment of the latching device 13 according to an embodiment of the invention. This has two identical levers 14; 15, which are connected to one another by a hinged joint 16 and can pivot relative to one another about the hinged joint 16. The touching surfaces of the levers 14; 15 contain working surfaces which are in the form of inclined surfaces 17; 18 and are in the form of a toothed system for the concentric parts 19; 20. In this case, the inclined surface 17 is designed to be steep as a snap-action surface, while the inclined surface 18 is designed to be flat, as a sliding surface.

The hinged joint 16 which connects the levers 14; 15 is formed by a hinge bolt 23 which passes through aligned through-holes 21; 22 in the levers 14; 15 and which at the same time form the guide and the holder for the contact-pressure spring 24, which is in the form of a helical compression spring, surrounds the hinge bolt 23 and is supported at the end of the hinge bolt 23 by means of a head 25, in the form of a disk, on it. At the opposite end of the hinge bolt 23 to the head 25, a thread 26 is provided in order to hold a nut 27, by use of which it is possible to vary the stress which is produced by the contact-pressure spring 24, which is seated on the hinge bolt 23. The two levers 14; 15 are thus subject to the variable spring pressure of the contact pressure spring 24. At the ends opposite the hinged joint 16, the levers 14; 15 have holders 30; 31, which are provided with a respective through-hole 28; 29, with these being used for the connection to the switching shaft lever 12 and to the contact support 7, respectively.

Figure 5:
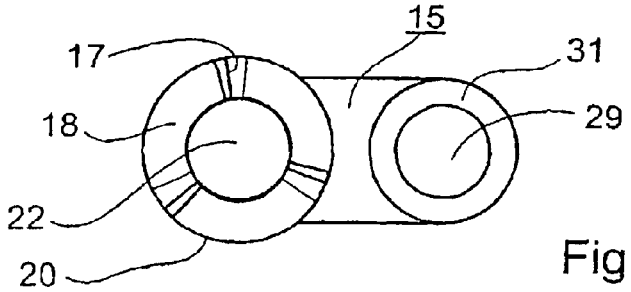
FIG. 5 shows a plan view of a single lever of the latching device according to an embodiment of the invention as shown in FIG. 4.

FIG. 5 shows a plan view of a single lever of the latching device according to the invention as shown in FIG. 4. The two levers 14; 15 are identical, for which reason only one lever 15 is shown. The working surfaces of the lever 15, which are in the form of inclined surfaces 17; 18, are arranged concentrically around the through-hole 22 for the hinge bolt 23 in the concentric part 20. The holder 31, which is provided with a through-hole 29 and is used for the connection to the switching shaft lever 12 and to the contact support 7, is arranged at the opposite end of the lever 15.

Figure 6:
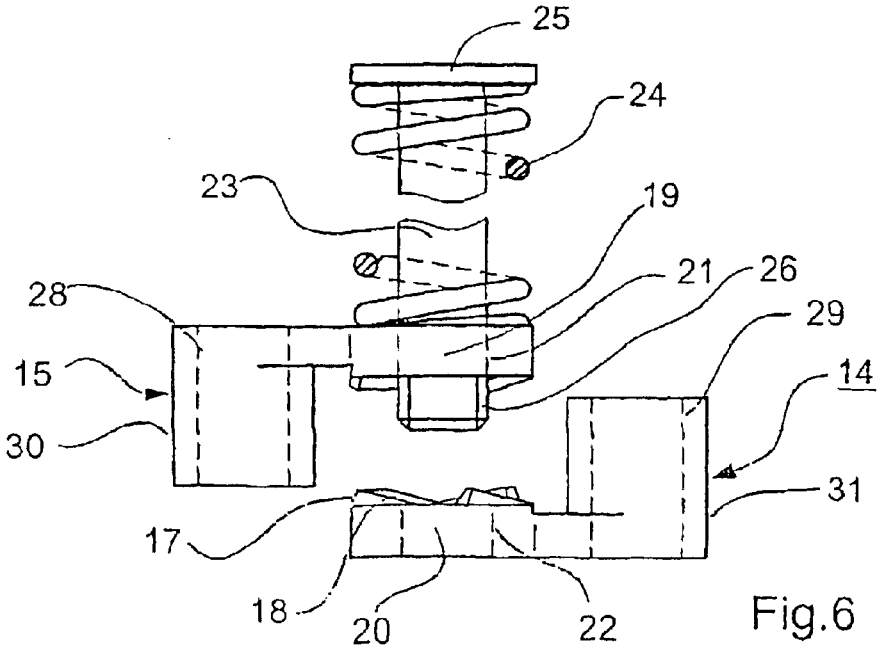
FIG. 6 shows the latching device according to an embodiment of the invention as shown in FIG. 1, partially assembled.

FIG. 6 shows the latching device 13 according to an embodiment of the invention, as shown in FIG. 1, partially assembled, with the nut 27 having been omitted. In this illustration, in which identical parts are provided with the same reference symbols to those used in FIG. 1, it is clearly possible to see the configuration of the inclined surfaces 17; 18 as a toothed system for the concentric parts 19; 20, which, in the assembled state, are subject to the spring pressure of the contact-pressure spring 24 which is seated on the hinge bolt 23.

The latching device 13 according to the invention operates as follows: If the opening force which is exerted by the electrodynamnic current forces and high current density forces on the contact system exceeds a predetermined value, for example in the event of a short circuit, which predetermined value allows the bending force to be sufficiently large that the lifting force which occurs on the adjacent inclined surfaces 17, which are in the form of snap-action surfaces, exceeds the spring force setting of the contact-pressure spring 24, these inclined surfaces slide off one another and snap over. In consequence, the latching device 13 bends in, and releases the moving switching contact 8. When, as snap-action surfaces, the inclined surfaces 17 have slid off one another, the inclined surfaces 18, as sliding surfaces which descend in the movement direction, no longer provide any resistance to prevent the latching device 13 from bending in.

The disconnection arc which is produced between the moving switching contact 8 and the stationary switching contact 5 in this unstable phase of the disconnection process during the opening of the moving switching contact 8, results in a resistance which limits the short-circuit current that flows, before, as the disconnection process progresses further, the electromagnetic quick-action release responds and the switch is finally disconnected.

When, as the disconnection process progresses further, the electromagnetic quick-action release finally disconnects the switch, the rotating switching shaft 11 and its switching shaft lever 12 result in the latching device 13 being moved back to its rest position. The switch is thus ready for reconnection.

The spring force of the contact-pressure spring 24 can be adjusted without any problems by varying the effective length of the hinge bolt 23 by screwing the nut 27 on to a greater or lesser extent, thus making it possible to control the operating force of the latching device 13.

The arrangement according to an embodiment of the invention has a mechanically very simple design, and nevertheless has the advantage that the operating force can be controlled without any problems. The two levers 14; 15 are identical, so that only one part need be produced, from the manufacturing point of view.

LIST OF REFERENCE SYMBOLS

1 Low-voltage circuit breaker
2 Rear wall
3 Upper connecting rail
4 Lower connecting rail
5 Stationary switching contact
6 Flexible connection
7 Contact support
8 Moving switching contact
9 Arcing chamber
10 Switch drive
11 Switching shaft
12 Switching shaft lever
13 Latching device
14 Lever
15 Lever
16 Hinged joint
17 Inclined surface
18 Inclined surface
19 Concentric part
20 Concentric part
21 Through-hole
22 Through-hole
23 Hinge bolt
24 Contact-pressure spring
25 Head
26 Thread
27 Nut
28 Through-hole
29 Through-hole
30 Holder
31 Holder The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A circuit breaker including current-limiting opening of a moving switching contact, comprising:

a drive apparatus for moving the switching contact to a connected position and to a disconnected position; and a latching device, arranged in the path of a force transmission from the drive apparatus to the switching contact, wherein the latching device, starting with the switching contact in the connected position, is adapted to be released by use of an opening force originating from the switching contact and acting in the direction of the disconnected position, when the opening force exceeds a predetermined limit value, wherein the latching device is in the form of a mechanical connecting element between the drive apparatus and the moving switching contact, including at least two interacting working surfaces arranged at an angle to the direction of the opening force, and including a contact-pressure spring adapted to act on the working surfaces, wherein the latching device includes two levers, connected to one another by a hinged joint formed by a hinge bolt, passed through aligned through-holes in concentric parts of the levers, wherein the levers are designed to be identical and designed to pivot relative to one another about the hinged joint, wherein the levers include inclined surfaces, adapted to act as a toothed system, on the concentric parts on their touching surfaces in the area of the hinged joint, wherein the levers are arranged concentrically around the through-holes for the hinge bolt and wherein a spring force generated by a contact-pressure spring, which acts on the toothed system that is formed by the inclined surfaces on their touching surfaces, is adapted to act on the concentric parts of the levers, wherein, when the latching device is in the rest state, the levers are at an angle to one another, which is not the same as the angle when they are in the extended position, in order to produce a relative torque which is dependent on the opening force, and wherein those ends of the levers facing away from the hinged joint include holders, provided with through-holes for hinged connection to the switching contact and, respectively, to the drive apparatus.

2. The circuit breaker as claimed in claim 1, wherein the hinge bolt includes a head at one of its ends, as an opposing bearing for the contact-pressure spring, and at its other end includes seating for a nut.

3. The circuit breaker as claimed in claim 1, wherein the inclined surfaces, used as a toothed system and adapted to move toward one another when the latching device is loaded in the rotation direction of the levers, include steep flanks as snap-action surfaces.

4. The circuit breaker as claimed in claim 1, wherein the inclined surfaces, used as a toothed system and adapted to move away from one another when the latching device is loaded in the rotation direction of the levers, are designed with flat flanks as sliding surfaces.

5. The circuit breaker as claimed in claim 1, wherein the contact-pressure spring is in the form of a helical compression spring, surrounding the hinge bolt and supported on the head of the hinge bolt.

6. The circuit breaker as claimed in claim 1, wherein the axis of the hinged joint connecting the levers is arranged parallel to a pivoting axis of the moving switching contact.

7. The circuit breaker as claimed in claim 2, wherein the contact-pressure force, exerted by the contact-pressure spring the touching surfaces of the levers on the concentric parts in the area of the hinged joint by way of the inclined surfaces acting as a toothed system, are adjustable by varying the effective length of the hinge bolt.

8. The circuit breaker as claimed in claim 2, wherein the axis of the hinged joint which connects the levers is arranged parallel to a pivoting axis of the moving switching contact.

9. The circuit breaker as claimed in claim 3, wherein the contact-pressure force, exerted by the contact-pressure spring the touching surfaces of the levers on the concentric parts in the area of the hinged joint by way of the inclined surfaces acting as a toothed system, are adjustable by varying the effective length of the hinge bolt.

10. The circuit breaker as claimed in claim 4, wherein the contact-pressure force, exerted by the contact-pressure spring the touching surfaces of the levers on the concentric parts in the area of the hinged joint by way of the inclined surfaces acting as a toothed system, are adjustable by varying the effective length of the hinge bolt.

11. A circuit breaker including current-limiting opening of a moving switching contact, comprising:

drive means for moving the switching contact to a connected position and to a disconnected position; and latching means, arranged in the path of a force transmission from the drive apparatus to the switching contact, for being released by an opening force originating from the switching contact and acting in the direction of the disconnected position, when the opening force exceeds a predetermined limit value, wherein the latching means includes a mechanical connecting element between the drive apparatus and the moving switching contact, including at least two interacting working surfaces arranged at an angle to the direction of the opening force, and including a contact-pressure spring adapted to act on the working surfaces, wherein the latching means further includes two levers, connected to one another by a hinged joint formed by a hinge bolt, passed through aligned through-holes in concentric parts of the levers, wherein the levers are designed to be identical and designed to pivot relative to one another about the hinged joint, wherein the levers include inclined surfaces, adapted to act as a toothed system, on the concentric parts on their touching surfaces in the area of the hinged joint, wherein the levers are arranged concentrically around the through-holes for the hinge bolt and wherein a spring force generated by a contact-pressure spring, which acts on the toothed system that is formed by the inclined surfaces on their touching surfaces, is adapted to act on the concentric parts of the levers, wherein, when the latching means is in the rest state, the levers are at an angle to one another, which is not the same as the angle when they are in the extended position, in order to produce a relative torque which is dependent on the opening force, and wherein those ends of the levers facing away from the hinged joint include holders, provided with through-holes for hinged connection to the switching contact and, respectively, to the drive means.

12. The circuit breaker as claimed in claim 11, wherein the hinge bolt includes a head at one of its ends, as an opposing bearing for the contact-pressure spring, and at its other end includes seating for a nut.

13. The circuit breaker as claimed in claim 11, wherein the inclined surfaces, used as a toothed system and adapted to move toward one another when the latching means is loaded in the rotation direction of the levers, include steep flanks as snap-action surfaces.

14. The circuit breaker as claimed in claim 11, wherein the inclined surfaces, used as a toothed system and adapted to move away from one another when the latching means is loaded in the rotation direction of the levers, are designed with flat flanks as sliding surfaces.

15. The circuit breaker as claimed in claim 11, wherein the contact-pressure spring is in the form of a helical compression spring, surrounding the hinge bolt and supported on the head of the hinge bolt.

16. The circuit breaker as claimed in claim 1, wherein the axis of the hinged joint connecting the levers is arranged parallel to a pivoting axis of the moving switching contact.

17. The circuit breaker as claimed in claim 12, wherein the contact-pressure force, exerted by the contact-pressure spring the touching surfaces of the levers on the concentric parts in the area of the hinged joint by way of the inclined surfaces acting as a toothed system, are adjustable by varying the effective length of the hinge bolt.

18. The circuit breaker as claimed in claim 12, wherein the axis of the hinged joint which connects the levers is arranged parallel to a pivoting axis of the moving switching contact.

19. The circuit breaker as claimed in claim 13, wherein the contact-pressure force, exerted by the contact-pressure spring the touching surfaces of the levers on the concentric parts in the area of the hinged joint by way of the inclined surfaces acting as a toothed system, are adjustable by varying the effective length of the hinge bolt.

20. The circuit breaker as claimed in claim 14, wherein the contact-pressure force, exerted by the contact-pressure spring the touching surfaces of the levers on the concentric parts in the area of the hinged joint by way of the inclined surfaces acting as a toothed system, are adjustable by varying the effective length of the hinge bolt.

* * * * *